US009149862B2

(12) United States Patent
Draht

(10) Patent No.: US 9,149,862 B2
(45) Date of Patent: Oct. 6, 2015

(54) HYDRAULICALLY OPERATED SETTING DEVICE WITH A HYDRAULIC AGGREGATE AND A JOINING METHOD FOR CONNECTING AT LEAST TWO COMPONENTS

(75) Inventor: Torsten Draht, Schloss Holte (DE)

(73) Assignee: Bollhoff Verbindungstechnik GmbH (DE)

( * ) Notice: Subject to any disclaimer, the term of this patent is extended or adjusted under 35 U.S.C. 154(b) by 682 days.

(21) Appl. No.: 13/447,675

(22) Filed: Apr. 16, 2012

(65) Prior Publication Data

US 2012/0260647 A1 Oct. 18, 2012

(30) Foreign Application Priority Data

Apr. 14, 2011 (DE) ..... 10 2011 002 058

(51) Int. Cl.
*F16D 31/02* (2006.01)
*B21J 15/02* (2006.01)
*B21J 15/20* (2006.01)

(52) U.S. Cl.
CPC ..... *B21J 15/025* (2013.01); *B21J 15/20* (2013.01)

(58) Field of Classification Search
CPC ..... F16H 2061/307; F16H 61/30; F15B 2211/7053; F15B 15/1447
USPC ..... 92/62, 65; 91/436, 437; 173/207, 208, 173/138; 60/329
See application file for complete search history.

(56) References Cited

U.S. PATENT DOCUMENTS

| | | | | | |
|---|---|---|---|---|---|
| 3,608,650 | A | * | 9/1971 | Matsusaka | 173/114 |
| 4,667,570 | A | * | 5/1987 | Jensen et al. | 91/420 |
| 5,392,865 | A | * | 2/1995 | Piras | 173/17 |
| 5,709,083 | A | * | 1/1998 | Sorbel et al. | 60/394 |
| 5,996,465 | A | * | 12/1999 | Morikawa et al. | 91/420 |
| 2005/0051026 | A1 | * | 3/2005 | Nielsen et al. | 91/462 |

FOREIGN PATENT DOCUMENTS

| | | | |
|---|---|---|---|
| CN | 201650928 | U | 11/2010 |
| DE | 100 22 255 | A1 | 11/2000 |
| DE | 10 2009 040 126 | A1 | 3/2011 |
| WO | WO 2011/026944 | A1 | 3/2011 |

OTHER PUBLICATIONS

German Search Report for DE 10 2011 002 058.6; dated Nov. 3, 2011; 5 pages.

* cited by examiner

*Primary Examiner* — Edward Look
*Assistant Examiner* — Jason Mikus
(74) *Attorney, Agent, or Firm* — Barclay Damon, LLP

(57) ABSTRACT

A hydraulically operated setting device with a hydraulic aggregate as well as a joining method for connecting at least two components with the help of the hydraulically operated setting device is described. The cycle times compared to conventional joining methods are reduced through the targeted use of volume flows of hydraulic fluid in the prestroke chamber and the return-stroke chamber of the piston in connection with the plunger and the hold-down device chamber in connection with the plunge piston and the hold-down device.

27 Claims, 4 Drawing Sheets

HYDRAULICALLY OPERATED SETTING DEVICE WITH A HYDRAULIC AGGREGATE AND A JOINING METHOD FOR CONNECTING AT LEAST TWO COMPONENTS

FIELD OF THE INVENTION

The present invention relates to a hydraulically operated setting device with a hydraulic aggregate for establishing a connection between at least two components, in particular a rivet setting device, a joining method for connecting at least two components, in particular a setting method for a punch rivet or a clinch method, with the help of the hydraulically operated setting device as well as a joint connection between at least two components, which was established with the help of the hydraulically operated setting device or the joining method.

BACKGROUND OF THE INVENTION

The present invention relates to a hydraulically operated setting device, to which the powering hydraulic fluid is supplied with the help of a hydraulic aggregate. The hydraulic fluid supplies a piston/cylinder arrangement of the setting device, which moves both a plunger for inserting a connection element, for example a punch rivet, as well as a hold-down device or nose. The setting device is connected with the hydraulic aggregate for this purpose. The hydraulic aggregate comprises a tank for storing hydraulic fluid, such as oil. Moreover, the hydraulic aggregate is equipped with a pump, which pumps the hydraulic fluid out of the tank to the setting device. Since the setting device is usually arranged on an industrial robot, long hydraulic hoses for conveying the hydraulic fluid connect the hydraulic aggregate with the setting device. Depending on the pressure and the volume flows of the hydraulic fluid, which can be generated with the help of the hydraulic aggregate, certain cycle times result, which are required for example for the setting of a punch rivet in at least two components. Furthermore, the cycle time for a setting procedure is impacted by the speed of the hydraulic cylinder during the process of the plunger and the hold-down device.

Since the cycle times of known setting devices with a hydraulic aggregate are not satisfactory, it is one object of the present invention to provide a setting device with a hydraulic aggregate as well as a joining method for connecting at least two components, which requires a shorter cycle time for establishing a connection between two components compared to the state of the art.

SUMMARY OF THE INVENTION

The above problem is solved through a hydraulically operated setting device with a hydraulic aggregate for establishing a connection between at least two components, in particular a rivet setting device. Furthermore, the joining method according to the invention for connecting at least two components, in particular a setting method for a punch rivet as well as a clinch method, solves the above object. Moreover, the present invention comprises a joint connection between at least two components, in particular a punch rivet or clinch connection, which were established with the aforementioned joining method or the aforementioned hydraulically operated setting device. Advantageous embodiments and further developments of the present invention result from the following description, the accompanying drawings and the attached claims.

The hydraulically operated setting device according to the invention with a hydraulic aggregate for establishing a connection between at least two components, in particular a rivet setting device, has the following features: the hydraulic aggregate with a tank for hydraulic fluid, a pump for pumping the hydraulic fluid to the setting device, at least one pump hose, which connects the tank with the setting device via the pump and a valve block, and a tank hose, which connects the tank with the setting device via the valve block, a double-acting cylinder with a prestroke chamber and a return-stroke chamber, in which the piston with piston rod is moveably arranged, which moves a plunger of the setting device, a single-acting cylinder with a hold-down device chamber, in which a plunge piston is moveably arranged, which moves a hold-down device, wherein the valve block comprises a plurality of valves, via which the return-stroke chamber can be connected with the pump and the hold-down device chamber, so that a volume flow of the hydraulic fluid from the hold-down device chamber supports a resetting movement of the piston.

During a setting procedure, hydraulic fluid is first pumped into the prestroke chamber of the double-acting cylinder, the piston rod of which moves the plunger in the setting direction to the components to be connected. The volume of hydraulic fluid displaced out of the return-stroke chamber of the double-acting cylinder during this procedure is conveyed to the prestroke chamber and the hold-down device chamber in order to support, preferably accelerate, through the additional volume flow of hydraulic fluid, the delivery of the piston and plunger as well as the hold-down device in the setting direction. For this purpose, the double-acting cylinder for moving the plunger of the setting device is designed differently than a differential cylinder, the piston surface without piston rod of which is larger in the prestroke chamber than the piston surface with piston rod in the return-stroke chamber.

After the plunger has been moved to the components through sufficiently high hydraulic pressure in the prestroke chamber and a connection has been established between the two components, the plunger must be reset via the double-acting cylinder and the hold-down device must be reset via the plunge piston opposite to the setting direction in order to be able to begin a new connection procedure. While the plunge piston with hold-down device moves opposite to the setting direction within the hold-down device chamber, hydraulic fluid is displaced out of the hold-down device chamber. According to the invention, this displaced volume of hydraulic fluid is supplied to the return-stroke chamber of the double-acting cylinder in order to increase the hydraulic volume flow resetting the piston with the plunger opposite to the setting direction. The movement of the piston is accelerated in connection with the plunger through this increased volume flow of hydraulic fluid.

Since the cycle time of the setting procedure results from the duration of the movement of the plunger out of its initial position into the joining position for establishing the connection and back into its initial position, the movement of the piston with the plunger is accelerated through the guidance of the hydraulic volume flows described above and thus the cycle time is shortened.

In accordance with a preferred embodiment of the hydraulically operated setting device, the hold-down device is mechanically coupled with the plunger such that the plunger carries along the hold-down device with a movement opposite to the setting direction and/or the hold-down device carries along the plunger with a movement in the setting direction. Due to this mechanical coupling, the volume flow of the hydraulic fluid fed into the hold-down device chamber supports a movement of the plunger in the setting direction on one hand. On the other hand, the carrying along of the hold-down device by the plunger supports the displacement of hydraulic fluid out of the hold-down device chamber, which is then supplied to the return-stroke chamber of the piston. This volume flow of hydraulic fluid directed out of the hold-down device chamber into the return-stroke chamber ensures an accelerated return of the piston with the plunger to its initial position compared to known setting devices.

In accordance with another preferred embodiment, the valve block for switching the volume flows of the hydraulic fluid is arranged next to the setting device so that the pump hose and the tank hose between the tank and valve block have a length of 5-30 m, preferably 8-22 m. Both the pump hose and the tank hose serve to facilitate circulation of the hydraulic fluid between the setting device and the hydraulic aggregate. Due to the length of the hoses, they can hold a certain volume of hydraulic fluid. Since the pump hose and the tank hose are made of a flexible material, which withstands the supply of volume flows of approximately 20-30 l/min as well as pressures of up to 300 bar in the hydraulic fluid, the pump and/or tank hose also serve as a hydraulic energy store, in which hydraulic fluid can be sealed in under a certain pressure and then selectively released at a certain point in time. This erratic release of the pressurized hydraulic fluid out of the pump and/or the tank hose preferably serves to accelerate the feed movement of the plunger to the components to be connected. It is also preferable to seal in the hydraulic fluid pressurized from the previous setting procedure in the pump and/or tank hose in order to avoid an energy loss through release of the hydraulic fluid and flowing of the hydraulic fluid into the tank of the hydraulic aggregate.

In accordance with another embodiment of the setting device according to the invention, the valve block is connected with at least the prestroke, the return-stroke and the hold-down device chamber via a plurality of hoses, each of which has a length of 0.15-6 m, preferably of 0.3-3 m.

The valve block and the valves realized in it control the volume flow of hydraulic fluid into different chambers of the setting device. Through the targeted shortening of the hydraulic hoses between the valve block and the cylinders of the setting device, the cycle times of the hydraulic fluid on the setting device are shortened. The volume flows of hydraulic fluid driven through the valve block do not need to first run through the pump and tank hose in order to activate the driven function in the case of the setting device. Instead, the hydraulic fluid controlled and released by the valve block only covers a short distance back to the setting device so that the time between valve activation and corresponding reaction of the setting device is shorter compared to the conventional systems. As soon as a valve releases a volume flow of hydraulic fluid, this volume flow goes right into the desired chamber based on the short connection hoses between the valve block and the prestroke, return-stroke and hold-down chamber of the setting device in order to create the desired movement there. The preferred lengths of the connection hoses between the valve block and setting device also ensure reduced pressure and energy losses of the energy saved in the hydraulic fluid.

It is also preferred to design the valve block as a strain release component for the setting device with respect to the connected pump hose and the connected tank hose. The valve block also preferably comprises at least two pressure sensors with which pressure is ascertainable in both the prestroke chamber and the hold-down device chamber. In accordance with another preferred embodiment of the present invention, the valve block of the hydraulically operated setting device is integrated into a cylinder arrangement consisting of the double-acting cylinder and the single-acting cylinder of the setting device. With the help of this construction, the hoses between the valve block and the prestroke, return-stroke and the hold-down chamber can be shortened further or even omitted. This constructive design shortens the distance to be travelled by the hydraulic fluid between switching valves and the double-acting cylinder, which moves the plunger, as well as the cylinder with plunge piston, which moves the hold-down device. Such a compact arrangement also results in a small interference contour of the setting device fastened for example on an industrial robot.

The present invention comprises a hydraulically operated setting device with a hydraulic aggregate for establishing a connection between at least two components, in particular a rivet setting device, which comprises the following characteristics: a) the hydraulic aggregate with a tank for hydraulic fluid, a pump for pumping the hydraulic fluid to the setting device, at least one pump hose, which connects the tank with the setting device via the pump and a valve block, and at least one tank hose, which connects the tank with the setting device via the valve block, b) a double-acting cylinder with a prestroke chamber and a return-stroke chamber, in which the piston with piston rod is moveably arranged, which moves a plunger of the setting device, c) a single-acting cylinder with a hold-down device chamber, in which a plunge piston is moveably arranged, which moves a hold-down device, wherein d) the valve block is arranged next to the setting device and is connected with at least the prestroke, the return-stroke and hold-down device chamber via a plurality of hoses, each of which has a length of 0.15-6 m, preferably of 0.3-3 m.

In accordance with an alternative embodiment of the setting device described above, the hydraulic hoses between the valve block and the cylinders of the setting device were shortened in a target manner. The cycle times of the hydraulic fluid in the setting device are reduced on this constructive basis. The volume flows of hydraulic fluid driven through the valve block do not need to first pass through the pump and tank hose in order to activate the driven function in the case of the setting device. Instead, the hydraulic fluid controlled and released by the valve block only covers a relatively short distance compared to the tank hose and pump hose up to the setting device so that the time between valve activation and corresponding reaction of the setting device is shorter compared to conventional systems. As soon as a valve releases a volume flow of hydraulic fluid, this volume flow goes right into the desired chamber based on the short connection hoses between the valve block and the prestroke, return-stroke and hold-down chamber of the setting device in order to create the desired movement there. The preferred lengths of the connection hoses between the valve block and setting device also ensure reduced pressure and energy losses of the energy saved in the hydraulic fluid.

In another preferred embodiment, the alternative setting device according to the invention comprises a pump hose and the tank hose between the tank and pump and valve block with a length of 5-30 m, preferably 8-22 m. In accordance with another preferred embodiment, the valve block also comprises a plurality of valves, via which the return-stroke chamber can be connected with the pump and the hold-down device chamber so that a volume flow of the hydraulic fluid out of the hold-down device chamber supports a reset movement of the piston. These preferred constructive embodiments were already explained above in connection with the first alternative of the setting device according to the invention and apply in the same manner for the second alternative of the setting device according to the invention.

The present invention also discloses a joining method for connecting at least two components, in particular a setting method for a punch rivet, with the help of a hydraulically operated setting device with a hydraulic aggregate, which comprises the following characteristics: the hydraulic aggregate with a tank for hydraulic fluid, a pump for pumping the hydraulic fluid to the setting device, at least one pump hose, which connects the tank with the setting device via the pump and a valve block, and a tank hose, which connects the tank with the setting device via the valve block, a double-acting cylinder with a prestroke chamber and a return-stroke chamber, in which the piston with piston rod is moveably arranged in order to drive the plunger, a single-acting cylinder with a hold-down device chamber, in which a plunge piston is moveably arranged in order to drive the hold-down device, wherein the valve block comprises a plurality of valves, via which the return-stroke chamber can be connected with the pump and the hold-down device chamber, wherein the setting method has the following steps: a) introducing a first hydraulic volume flow of the hydraulic fluid into the prestroke chamber and the hold-down device chamber so that the piston with the plunger and the plunge piston with hold-down device are moved out of an initial position in the setting direction, b) connecting the return-stroke chamber with the prestroke chamber and the hold-down device chamber in step a), so that a first hydraulic return flow of the hydraulic fluid is diverted out of the return-stroke chamber into the prestroke chamber and/or the hold-down device chamber, c) increasing the hydraulic pressure in the prestroke chamber after the hold-down device and the plunger engage at a component to be connected, and establishing a connection by setting the fastening element in the component or deforming the component, d) introducing a second hydraulic volume flow of the hydraulic fluid into the return-stroke chamber so that the piston is moved in the direction of the initial position, and e) connecting the hold-down device chamber with the return-stroke chamber in step d) so that a second hydraulic return flow of the hydraulic fluid is diverted out of the hold-down device chamber into the return-stroke chamber and supports the movement of the piston into the initial position.

With the help of the method according to the invention, the volume flows are diverted in a targeted manner during the advancement of the plunger and hold-down device in the setting direction as well as the resetting of the plunger and hold-down device opposite to the setting direction such that the volume flows of the hydraulic fluid support, preferably accelerate, the movement of the piston with the plunger in the respective direction. For this purpose, the volume of hydraulic fluid displaced out of the return-stroke chamber is fed to the hold-down device chamber and/or the prestroke chamber of the double-acting cylinder during the delivery of the piston with the plunger to the components to be connected. This fed volume flow of hydraulic fluid out of the return-stroke chamber increases the volume flow of hydraulic fluids provided by the pumps so that the movement of the double-acting cylinder and/or plunge piston with hold-down device is accelerated. The volume of hydraulic fluid displaced out of the return-stroke chamber through the plunge piston with hold-down device is also fed to the return-stroke chamber of the double-acting cylinder during the return movement of the double-acting cylinder to its initial position. This additional volume flow also ensures an accelerated reset of the piston with the plunger to its initial position. This targeted diversion of volume flows of hydraulic fluid creates a faster movement of the piston with the plunger as well as of the plunge piston with hold-down device whereby the cycle time of the joining process is reduced compared to the state of the art.

In accordance with a preferred embodiment of the present joining method, a carrying along of the plunge piston with the hold-down device takes place by the piston with the piston rod and the plunger when the piston moves back into its initial position. In this connection, it is preferred to start the aforementioned step e) as soon as the carrying along of the plunge piston with hold-down device takes place and the plunge piston displaces hydraulic fluid out of the hold-down device chamber.

In accordance with another preferred embodiment of the joining method according to the invention, before the start of step a), an overpressure hydraulic volume is created in the pump hose under increased pressure compared to a hydraulic pressure in the pump hose during the movement of the plunger and hold-down device in step a) and the overpressure hydraulic volume is released at the start of step a) so that the movement of the piston with the plunger and of the plunge piston with hold-down device is accelerated. As already mentioned above, the pump hose at least serves as an energy store for a pressurized volume of hydraulic fluid. This is based on the flexible material used to make the pump and tank hose. This flexibility of the hoses is also selectively taken advantage of in that valves in the progression of the pump hose and/or the tank hose are arranged so that a certain volume of hydraulic fluid can be sealed in the area between these valves under a preselected pressure or residual pressure after the end of a setting process. The energy thus stored in the hydraulic volume is thereby systematically released in that at least one of the valves is opened at a specific time so that the pressurized hydraulic volume is released in the direction of the opened valve and this hydraulic volume contributes to the support of the movement of the plunger and/or the hold-down device.

In accordance with another embodiment of the joining method according to the invention, the hydraulic fluid and the components of the circulation of the hydraulic fluid, in particular the valve blocks, the valves and the hoses, are heated to a desired operating temperature in that the hydraulic fluid is pumped into the tank via the pump hose, a pressure relief valve in the valve block and the tank hose and is heated by a pressure increase before and a pressure release after the pressure relief valve.

The present invention also comprises a joint connection between at least two components, in particular a punch rivet or a clinch connection, which is established with the joining method described above or the hydraulically operated setting device with hydraulic aggregate described above.

BRIEF DESCRIPTION OF THE ACCOMPANYING DRAWINGS

The preferred embodiments of the present invention are explained in greater detail in reference to the accompanying drawings.

DETAILED DESCRIPTION OF THE PREFERRED EMBODIMENTS

Figure 1:
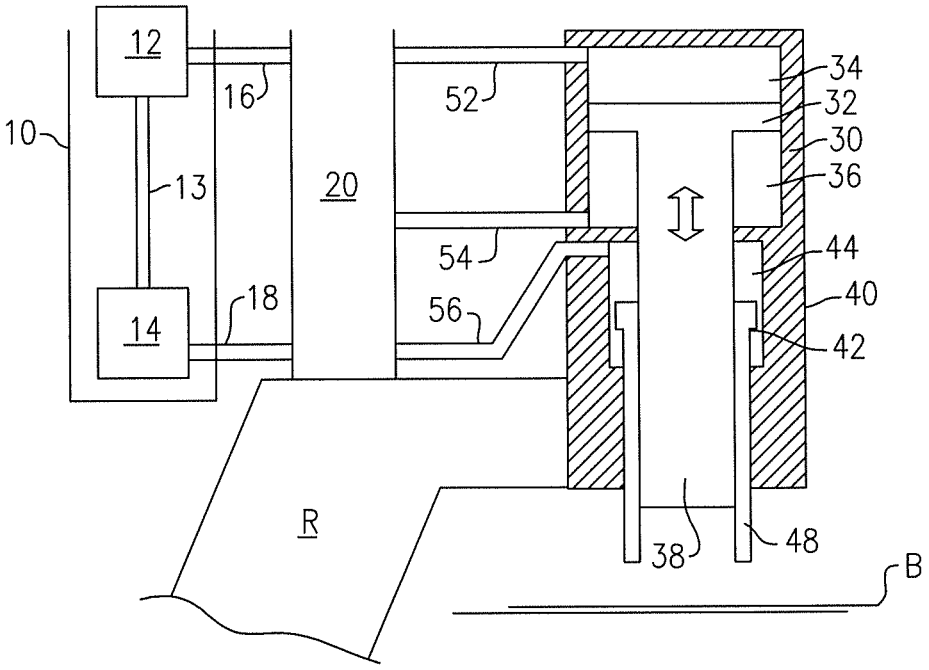
FIG. 1 is a schematic representation of a preferred embodiment of the hydraulically operated setting device with hydraulic aggregate.

FIG. 1 shows a schematic representation of the hydraulically operated setting device S with hydraulic aggregate 10.

The hydraulic aggregate 10 comprises a tank 14 with a known hydraulic fluid, for example oil. The hydraulic aggregate also has a pump 12, with which hydraulic fluid is pumped out of the tank 14 to the setting device S via a line 13. The hydraulic fluid is supplied to the setting device S via a pump hose 16. Hydraulic liquid flowing back from the setting device S reaches the tank 14 for hydraulic fluid via a tank hose 18.

A valve block 20, which controls the volume flows of the hydraulic fluid exchanged between the hydraulic aggregate 10 and the setting device S, is arranged between the hydraulic aggregate 10 and the setting device S. The valve block 20 controls the volume flow of the hydraulic fluid from the hydraulic aggregate 10 into the different areas 34, 36, 44 of the setting device S via a plurality of valves. The valve block 20 also controls the different volume flows of the hydraulic fluid between the different areas 34, 36, 44 of the setting device as well as from the setting device S to the tank 14 of the hydraulic aggregate 10.

The setting device S has a double-acting cylinder 30. A piston 32 of the double-acting cylinder 30 subdivides the double-acting cylinder 30 into a prestroke chamber 34 and a return-stroke chamber 36. In accordance with FIG. 1, the piston 32 is provided with a piston rod on the bottom, which is connected with a stamp or plunger 38. Based on this construction, the piston surface $A_1$ adjacent to the prestroke chamber 34 is greater than the piston surface $A_2$ adjacent to the return-stroke chamber 36.

The setting device S also comprises a single-acting cylinder 40. A plunge piston 42 is arranged in a hold-down device chamber 44 of the single-acting cylinder 40. The plunge piston 42 is connected with a hold-down device 48, which serves to immobilize components B to be connected before, during and/or after the connection of the components B.

The setting device S is connected with an industrial robot R, which moves the setting device S to the respective joints. The setting device S preferably has a C-frame. It is understood that the setting device S is also equipped with a force sensor and a path sensor in order to capture during the joining procedures the joining force applied by the plunger 38 as well as the path travelled by the plunger 38. In the same manner, it is preferred to equip the setting device S with a feed device for connection elements, in particular punch rivets or bolts. The feed device is designed to feed connection elements of one or different geometries to the setting device S.

The setting device S establishes a connection between the components B by moving the plunger 38 in the setting direction, that is in the direction of components B. This connection is realized for example with the help of punch rivets or bolts, while it is also preferred to establish a connection between the components B through clinching.

The valve block 20 for controlling the volume flows of the hydraulic fluid and thus the resulting pressures of the hydraulic fluid in the prestroke 34, return-stroke 36 and hold-down device chambers 44 is arranged next to the setting device S and arranged away from the hydraulic aggregate 10. The pump hose 16 and the tank hose 18 thus have a preferred length of 5-30 m between the hydraulic aggregate 10 and the valve block 20. In accordance with another preferred embodiment, the pump hose 16 and the tank hose 18 have a length of approximately 15-20 m.

In accordance with one alternative of the present invention, the valve block 20 is arranged next to the setting device S; i.e., the valve block 20 is preferably fastened on the setting device S or integrated into the cylinder arrangement 30, 40 of the setting device S. In accordance with another preferred embodiment, the valve block 20 is arranged on the C-frame of the setting device S or on the robot R adjacent to the setting device S. Based on this arrangement of the valve block 20, only hose lengths of 0.15-6 m, preferably of 0.3-3 m, are still required for the hydraulic lines 52, 54, 56, which connect the valve block with the prestroke 32, the return-stroke 36 and the hold-down device chamber 44. This constructive embodiment is also preferably used as a supplement to the further alternative of the setting device S according to the invention described below.

The setting device S is connected with the hydraulic aggregate 10 with the help of the pump hose 16 and the tank hose 18. The aforementioned length of the pump hose 16 and the tank hose 18 guarantees any arrangement of the hydraulic aggregate 10, with which a reliable supply of the setting device S with hydraulic fluid is nonetheless ensured. The pump hose 16 and the tank hose 18 guarantee that a sufficiently large volume of hydraulic fluid is present on the valve block 20 for the control of the setting device S through the valve block 20.

The relatively short connection hoses or lines 52, 54, 56 between the valve block 20 and the setting device S in comparison with the pump 16 and tank hose 18 realize faster reaching of the setting device S by the driven volume flow of hydraulic fluid as well as a faster pressure buildup in the hydraulic fluid in the setting device S compared to longer hoses. The faster pressure buildup and the associated shorter cycle times for the operation of the setting device S result in shortened cycle times for the operating of the setting device S result in shortened cycle times for the establishment of a connection compared with conventional setting devices.

The double-acting cylinder 30 is preferably operated in a first differential switch. For this purpose, the surfaces $A_1$ and $A_2$ of the piston 32 adjacent to the prestroke chamber 34 and the return-stroke chamber 36 are designed with different sizes. For example, if the same hydraulic pressure is applied in the prestroke 34 and return-stroke chamber 36, opposite, differently sized forces that move the piston 32 act due to differently sized surfaces $A_1$, $A_2$ of the piston 32 on both sides of the piston 32. In accordance with one embodiment, the surface ratio $\Phi$ of the surfaces $A_1$ to $A_2$ of the piston 32 of the double-acting cylinder 30 lies in the range of 1.1-1.8, preferably at 1.15 to 1.4.

The differently sized forces on the surfaces $A_1$, $A_2$ of the piston 32 cause the piston 32 to move in the direction of the greater force. The movement of the piston 32 created by the effect of the greater force is preferably also supported in that a volume flow of hydraulic fluid is introduced to the chamber 34, 36, 44 of the greater action of force. In this manner, the movement of the piston 32 is accelerated without significantly changing the action of force.

In accordance with another alternative of the setting device according to the invention, the return-stroke chamber 36 and the hold-down device chamber 44 are interconnected via a second differential switch. This constructive embodiment is also preferably used as a supplement to the alternative of the setting device S according to the invention described above.

The bottom side $A_2$ of the piston 32 and the top side of the plunge piston 42 preferably have a surface ratio $\Phi_2$ of 1.5-5, preferably 1.8-3.6.

To support the first and second differential switch, the piston rod of the piston 32 with the plunger 38 and the plunge piston 42 with hold-down device 48 are mechanically coupled with each other. The mechanical coupling 39 is designed such that the plunge piston 42 with hold-down device carries along the piston 32 via the piston rod and the plunger 38 during a movement in the setting direction, that is towards components B. In the case of a movement of the piston 32 with the plunger 38 opposite to the setting direction, that is away from components B, the piston 32 carries the plunge piston 42 and the hold-down device via the plunger 38.

Through the carrying along, hydraulic fluid is displaced as a volume flow out of the return-stroke chamber 36 or the hold-down device chamber 44. The pump 12 is first connected with the prestroke chamber 34 via the pump hose 16 and feeds it a constant volume flow of hydraulic fluid. In order to support or respectively accelerate the movement of the piston 32 with the plunger 38 generated by the first differential switch in the setting direction, the hydraulic fluid displaced out of the return-stroke chamber 36 is fed to the prestroke chamber 34. In another operating state, the pump 12 is connected with the return-stroke chamber 36 via the pump hose 16 so that the plunger 38 carries along the hold-down device 48. In order to support and accelerate the movement of the piston 32 with the plunger 38 generated by the second differential switch opposite to the setting direction, the hydraulic fluid displaced out of the hold-down device chamber 44 is fed to the return-stroke chamber 36. The respectively increased volume flow of hydraulic fluid ensures an acceleration of the already occurring movement of the piston 32 in one direction or the other.

In order to able to reliably monitor the pressure states in the different chambers 34, 36 and 44 of the setting device S, at least the prestroke chamber 34 and the hold-down device chamber 34 are respectively connected with a separate pressure sensor. It is also preferred to also equip the return-stroke chamber 36 with a pressure sensor.

In accordance with another preferred embodiment, the valve block 20 not only serves to connect the pump hose 16 and the tank hose 18 with the setting device S. That is, the valve block 20 further realizes a stress relief with respect to the pump hose 16 and the tank hose 18 so that the tractive forces generated via the pump hose 16 and the tank hose 18 are not transferred to the setting device S.

In accordance with another preferred embodiment, the valve block 20 with its plurality of valves is integrated into the cylinder arrangement 30, 40 consisting of the double-acting cylinder 30 and the single-acting cylinder 40. On this constructive basis, the valve block 20 does not have to be arranged as a separate part on the setting device S or in close proximity to the setting device S, for example on its C-frame or robot R. The pump hose 16 and the tank hose 18 are then directly connected to the cylinder arrangement 30, 40 of the setting device S with the integrated valve block 20. On this constructive basis, it is possible to further reduce the interference contour of the setting device S in order to achieve greater flexibility in the case of the reaching of joints, at which components B should be interconnected.

Figure 2:
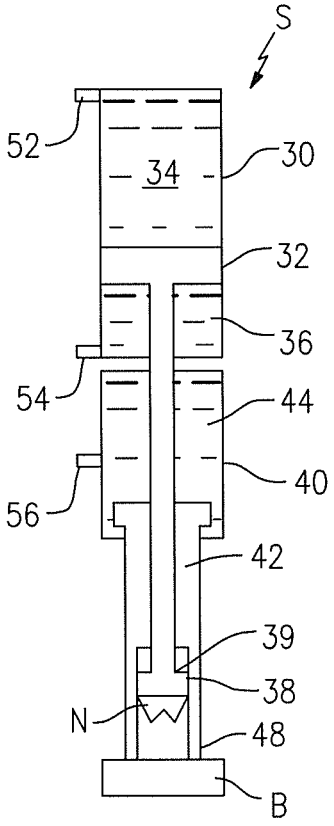
FIG. 2 is a simplified representation of the hydraulically operated setting device of FIG. 1.
Figure 3:
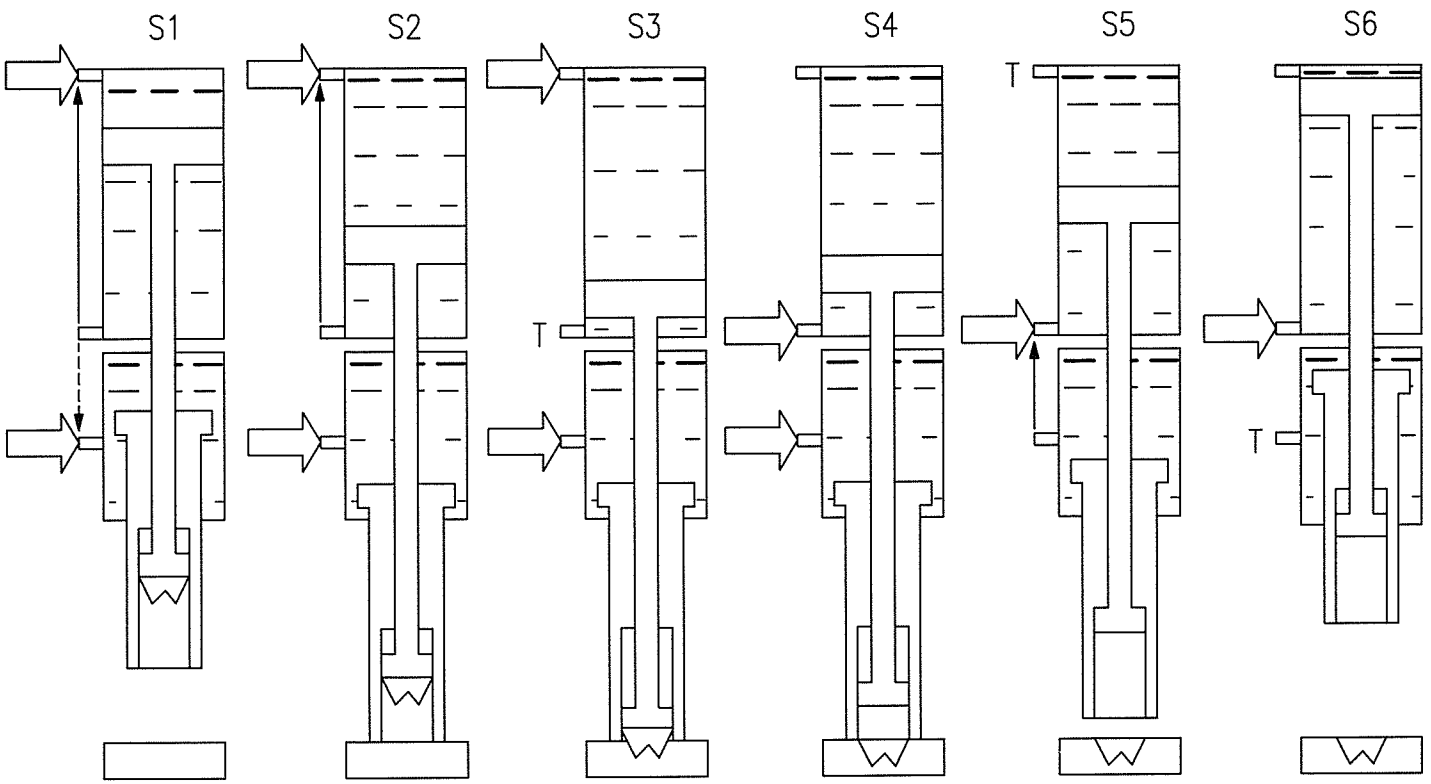
FIG. 3 is a representation of individual sequences of a preferred embodiment of the joining method according to the invention.
Figure 4:
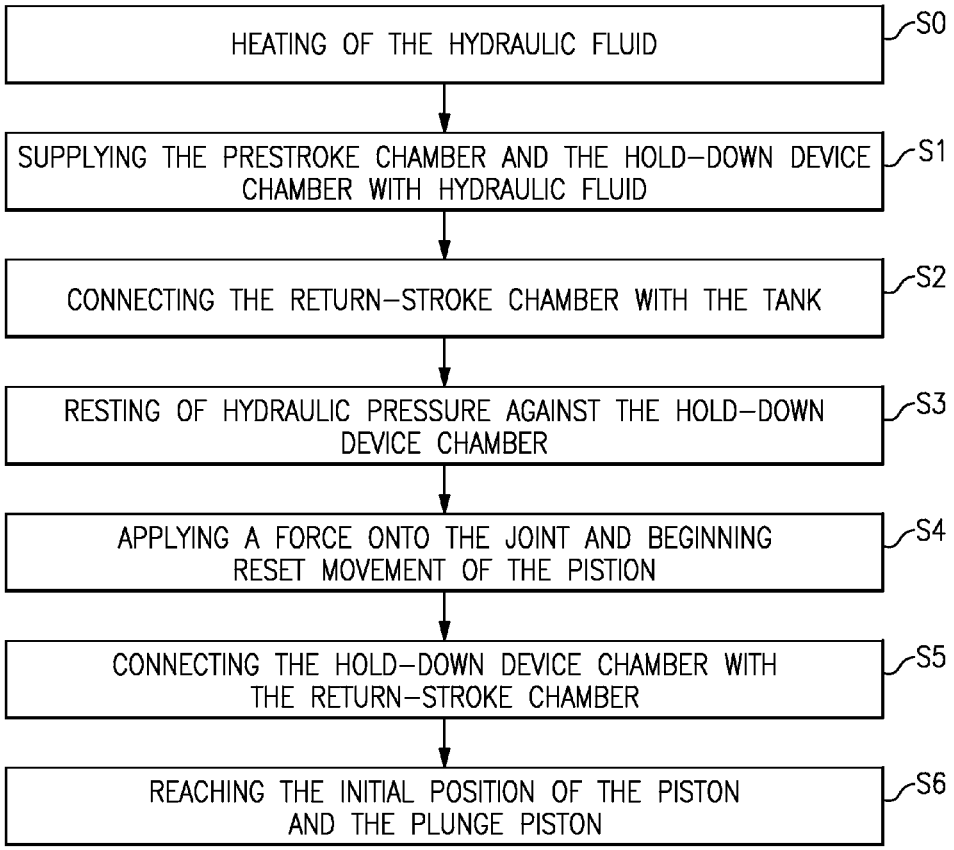
FIG. 4 is a preferred embodiment of the joining method in the form of a flow chart.

A preferred embodiment of the joining method according to the invention results from FIGS. 2-4. FIG. 3 shows a schematic representation of the joining method based on six selected states of the setting device S, which illustrate consecutive process steps 1-6. FIG. 2 contains the explanation of the hydraulically operating setting device S represented schematically in FIG. 3. FIG. 4 shows a preferred embodiment of the joining method according to the invention in a flow chart.

The hydraulically operated setting device S is represented in a simplified and schematic manner in FIG. 2. The representation of the hydraulic aggregate 10 was omitted in this case. But it goes without saying that the hydraulically operated setting device S shown in FIG. 2 is supplied with hydraulic fluid via the pump hose 16 as well as the tank hose 18 of the hydraulic aggregate 10 with the pump 12 and the tank 14.

The hydraulically operated setting device S in FIG. 2 comprises the double-acting cylinder 30 in which the piston 32 is arranged. The piston 32 subdivides the double-acting cylinder 30 into the prestroke chamber 34 and the return-stroke chamber 36. The prestroke chamber 34 is supplied with hydraulic fluid via the connection or respectively the line 52, while the return-stroke chamber 36 is supplied with hydraulic fluid via the connection or respectively the line 54. The piston 32 is connected with a piston rod on one side, which is connected in turn with the plunger 38. The hydraulically operated setting device S also has the single-acting cylinder 40, in which the plunge piston 42 is arranged. The plunge piston 42 moves within the hold-down device chamber 44, which is supplied with hydraulic fluid via the connection or respectively the line 56. The plunge piston 42 is connected with the hold-down device 48. The piston rod or respectively the plunger 38 and the hold-down device 48 are here coupled with each other mechanically at the point indicated with reference number 39 such that the hold-down device carries along the piston 32 during a movement in the setting direction and the plunger 38 carries along the hold-down device 48 and the plunge piston 42 during a movement of the piston 32 opposite to the setting direction. A punch rivet N is schematically arranged on the bottom of the plunger 38 as seen from the setting device. In the case of further movement of the plunger in the setting direction, the punch rivet N is set in the components B. The hydraulically operated setting device S is connected with the hydraulic aggregate 10, the pump 12 of which feeds hydraulic fluid out of tank 14 via the valve block 20 to the setting device S at a constant feed rate. The feed rate of the pump 12 preferably lies in the range of 15-30 l/min.

In an optional preparatory step for the hydraulically operated setting device S, the hydraulic fluid is heated in step S0 in order to avoid operating fluctuations due to changes in the temperature of the hydraulic fluid. For this purpose, the hydraulic fluid is moved in a circulation between the hydraulic aggregate 10 and the valve block 20. The valve block 20 prevents the hydraulic fluid to be heated from getting to the setting device S through a blocking of lines 52, 54, 56. A pressure relief valve, preferably an adjustable proportional valve, is provided within the valve block 20. The pump 12 pumps the hydraulic fluid out of the tank 14 via the pump line 16 up to the valve block 20. The hydraulic fluid is blocked by the pressure relief valve so that the pressure on the valve block 20 increases. The pressure preferably increases to a range of 70-150 bar in the hydraulic fluid, more preferably up to 125 bar. As soon as the pressure in the hydraulic fluid at the valve block 20 exceeds the set pressure valve, the pressure relief valve releases the hydraulic line so that after the pressure relief valve the pressure in the hydraulic fluid decreases and the hydraulic fluid flows back to tank 14 via tank line 18. Since the valve block 20 is arranged directly on the setting device S, approximately 90% of the hydraulic fluid in circulation moves via the pressure relief valve in the valve block 20. Since the pressure in the hydraulic fluid increases in front of the pressure relief valve and drops again after the pressure relief valve, the hydraulic fluid is heated by the pressure change. In the case of a pressure change of 100 bar, the hydraulic fluid heats by 6 K.

It is preferred to move the hydraulic fluid within a timeframe of 10-15 minutes in the circulation between hydraulic aggregate 10 and pressure relief valve of the valve block 20 until the desired operating temperature of preferably 30-60° C., in particular approximately 40° C., is reached. During the circulation of the heated hydraulic fluid, the pump hose 16, the tank hose 18, the valve block 20 and the valves arranged therein are also heated and brought to the desired operating temperature. The quantity of hydraulic fluid remaining in the setting device S is relatively small compared to the heated quantity of hydraulic fluid so that it mixes with the heated hydraulic fluid during operation of the setting device and thereby also reaches the operating temperature of the heated hydraulic fluid for a short period of time. The cylinder arrangement 30, 40 of the setting device S is then thereby brought to the desired operating temperature.

The components shown in FIG. 3 of the hydraulically operated setting device S correspond to the components of the setting device S of FIG. 2. For reasons of clarity, reference numbers were left out of FIG. 3. A preferred embodiment of the joining method proceeds in the following steps:

First, an auxiliary joint part N, for example a punch rivet or bolt, is fed to the setting device S.

In step S1 of the joining method shown in FIG. 3, the prestroke chamber 34 and the hold-down device chamber 44 are supplied with hydraulic fluid via the pump 12 and the connections 52 and 56. Preferably, a proportional valve is located upstream of the prestroke chamber 34 and the hold-down device chamber 44 in order to be able to adjust the maximum pressure of the hydraulic fluid in both chambers. In accordance with one embodiment, the hydraulic pressure is set in the range of 20-80 bar.

The return-stroke chamber 36 is also connected with the prestroke chamber 34 and optionally with the hold-down device chamber 44. This connection results in the same hydraulic pressure in the prestroke chamber 34, the return-stroke chamber 36 and the hold-down device chamber 44. The differences in the piston surfaces $A_1$ and $A_2$ of the piston 32 (see above) cause the piston 32 with the plunger 38 to be moved in the setting direction. The hold-down device 48 carries the plunger 38 with piston 32 via the mechanical coupling 39 between the hold-down device 48 and the plunger 38. The plunge piston 42 contributes in this manner to the movement of the piston 32 with the plunger 38 in the setting direction. The connection between the return-stroke chamber 36 and the prestroke chamber 34 and hold-down device chamber 44 ensures an increased volume flow of hydraulic fluid to the prestroke chamber 34 and the hold-down device chamber 44, since the hydraulic fluid displaced out of the return-stroke chamber 34 is diverted to it. This accelerates the movement of the piston 32 and the plunge piston 42 in setting direction compared to operation without a flow connection between the chambers 34, 36, 44.

As soon as the hold-down device 48 is placed on the components B, the hydraulic fluid displaced out of the return-stroke chamber 36 flows alone into the prestroke chamber 34. The hold-down device 48 is pressed onto the components B via the plunge piston 42 and the hydraulic pressure against the hold-down device chamber 44 in the range of 0-120 bar and holds it tight. In the same manner, it is preferred to reduce the pressure in the hold-down device chamber 44 so that the hold-down device 48 only lies on the components B without action of force. This situation is shown in the schematic representation overwritten with 2 in FIG. 3.

In accordance with a preferred embodiment of the joining method, the pump 12 delivers a hydraulic volume flow of 23 l/min. In step S1 (see FIG. 3), this hydraulic volume flow delivered by the pump 12 is separated into the prestroke chamber 34 and the hold-down device chamber 44. The prestroke chamber 34 is thus preferably supplied with a hydraulic volume flow of 9 l/min and the hold-down device chamber 44 with a hydraulic volume flow of 14 l/min. Through the diversion of the hydraulic fluid displaced out of the return-stroke chamber 36 into the prestroke chamber 34, the hydraulic volume flow moving the piston 32 increases to approximately 36 l/min.

It is also preferred to connect the return-stroke chamber 36 with the tank 14 via the tank line 18 in step S2. In this manner, the hydraulic pressure in the return-stroke chamber 36 is mainly reduced since the hydraulic fluid displaced out of the return-stroke chamber 36 can almost flow into tank 14 without resistance.

In step S3, a hydraulic pressure in the range of 0-100 bar rests against the hold-down device chamber 44 via the line 56. Depending on the selected hydraulic pressure, the hold-down device 48 immobilizes the components B in differently strong manners or not at all. While the return-stroke chamber 36 in step S3 continues to be connected with the tank 14 and is thereby almost pressureless, a hydraulic pressure in the range of 50-250 bar is generated in the prestroke chamber 34. The force with which the plunger 38 sets the auxiliary joint part N into the components B results depending on the size of the surface $A_1$ of the piston 32.

After the connection between the components B has been established or respectively the punch rivet N has been set in step S3, force is once again applied to the components B and the joint preferably through the hold-down device 48 alone or in combination with the plunger 38. For this, the hydraulic pressure in the prestroke chamber 34 and in the hold-down device chamber 44 is simultaneously increased. In accordance with another embodiment of the present joining method, the hydraulic pressure in the prestroke chamber 34 is reduced and the hydraulic pressure in the hold-down device chamber 44 increases to a value in the range of 50-100 bar. In this manner, only the hold-down device 48 in the area of the joint applies a force.

In accordance with step S4, it is also preferred to apply a force through increased hydraulic pressure in the hold-down device chamber 44 through the hold-down device 48 onto the joint, while the reset movement of the piston 32 with the plunger 38 begins simultaneously. For the reset movement of the piston 32 with the plunger 38, the prestroke chamber 34 is connected with the tank 14 in order to ensure a displacement of the hydraulic fluid out of the prestroke chamber 34 with little flow resistance. A volume flow of hydraulic fluid is simultaneously fed to the connection 54 via the pump 12, that is into the return-stroke chamber 36. The hydraulic fluid fed to the return-stroke chamber 36 with a preferred pressure in the range of approximately 50 bar moves the piston 32 with the plunger 38 opposite to the setting direction of the components B.

As soon as the plunger 38 in its movement opposite to the setting direction has reached a certain position, it carries along the hold-down device 48 via the mechanical coupling 39, for example an undercut in the plunger 38. In order to provide the higher force required for this movement for the movement of piston 32 with the plunger 38 and carried-along hold-down device 48, the hydraulic pressure in the return-stroke chamber 36 is preferably increased to approximately 80-120 bar, and preferably 100 bar.

The carrying along of the hold-down device 48 and thus of the plunge piston 42 by the plunger 38 displaces hydraulic fluid out of the hold-down chamber 44. The volume flow of the hydraulic fluid displaced out of the hold-down device chamber 34 is preferably diverted into the return-stroke chamber 36 in that the connections 54 and 56 are interconnected. By connecting the return-stroke chamber 36 and the hold-down device chamber 44 with each other, the same hydraulic pressure exists in the return-stroke chamber 36 and the hold-down device chamber 44. Based on the greater surface $A_2$ on the bottom side of the piston 32 compared to the surface of the plunge piston 42, a force results, which moves the piston 32 together with the plunge piston 42 opposite to the setting direction. The volume flow of the hydraulic fluid displaced out of the hold-down device chamber 44 into the return-stroke chamber 36 also supports the reset movement of the piston 32 with the plunger 38 and carried along hold-down device 48.

It is preferred that the pump 12 for the reset movement of the piston 32 with the plunger 38 provides a volume flow of hydraulic fluid of 23 l/min. This volume flow provided by the pump 12 is supplemented by a volume flow of approximately 21 l/min of displaced hydraulic fluid out of the hold-down device chamber 44 so that a volume flow of hydraulic fluid resetting the piston 32 of 44 l/min results. The increased volume flow of hydraulic fluid for the return of the piston 32 and thus the plunger 38 ensures a reduced cycle time for the joining process.

After the piston 32 and the plunge piston 42 have reached their initial position in step S6, the hold-down device chamber 44 is connected with the tank 14.

In accordance with another preferred embodiment of the joining method according to the invention, it is prevented after completion of the setting procedure that the residual pressure still remaining in the hydraulic lines for supplying the prestroke chamber 34 and/or the hold-down device chamber 44 is completely relieved in the hydraulic fluid. The hydraulic fluid is preferably sealed in the pump hose 16 with a residual pressure of 30-200 bar, preferably 50-100 bar, with the help of a return valve, which is arranged on the hydraulic aggregate 10 and another valve in the valve block 20. Since it is prevented that the hydraulic residual pressure is relived in the pump hose 16, the energy saved in this manner in the pump hose 16 can be used in the pressurized hydraulic fluid for the following setting procedure. It is thus preferred to release the pressurized hydraulic volume sealed in the pump hose 16 at the beginning of the step Si into the prestroke chamber 34 and/or the hold-down device chamber 44. This targeted release of the hydraulic volume with residual pressure out of the pump hose 16 creates an accelerated feed movement of the piston 32 in the setting direction. Residual energy out of the completed setting procedure is thereby saved on one hand and this energy is used via the introduction of the hydraulic fluid under residual pressure in step S1 for accelerated feed of the plunger 38 and/or the hold-down device 48 on the other hand. This accelerated feed of the plunger 38 and/or the hold-down device 48 leads in turn to a shortening of the cycle time compared to the operation of the setting device S without the feeding of the volume of hydraulic fluid sealed under residual pressure.

The invention claimed is:

1. A hydraulically operated setting device with a hydraulic aggregate for establishing a connection between at least two components, said hydraulic aggregate comprising:

a tank for hydraulic fluid, a pump for pumping the hydraulic fluid to the setting device, at least one pump hose, which connects the tank via the pump and a valve block with the setting device, and at least one tank hose, which connects the tank with the setting device via the valve block, said setting device further comprising:

a double-acting cylinder with a prestroke chamber and a return-stroke chamber, in which a piston with piston rod is moveably arranged, which moves a plunger of the setting device, a single-acting cylinder with a hold-down device chamber, in which a plunge piston is moveably arranged, which moves a hold-down device, wherein the valve block comprises a plurality of valves, via which the return-stroke chamber is connectable with the pump and the hold-down device chamber so that a volume flow of the hydraulic fluid out of the hold-down device chamber supports a reset movement of the piston.

2. The setting device according to claim 1, in which the valve block is arranged next to the setting device so that the pump hose and the tank hose have a length of approximately 5-30 m, between the tank and the valve block.

3. The setting device according to claim 1, in which the valve block is connected with at least the prestroke chamber, the return-stroke chamber and the hold-down device chamber via a plurality of hoses, each of which have a length between 0.15-6 m.

4. A hydraulically operated setting device with a hydraulic aggregate for establishing a connection between at least two components, the hydraulic aggregate comprising:

a tank for hydraulic fluid, a pump for pumping the hydraulic fluid to the setting device, at least one pump hose, which connects the tank via the pump and a valve block with the setting device, and at least one tank hose, which connects the tank with the setting device via the valve block, the setting device further comprising:

a double-acting cylinder having a prestroke chamber and a return-stroke chamber, in which a piston with piston rod is moveably arranged, which moves a plunger of the setting device, a single-acting cylinder with a hold-down device chamber, in which a plunge piston is moveably arranged, which moves a hold-down device, wherein the valve block is located adjacent to the hydraulically operated setting device and connected with at least the prestroke chamber, the return-stroke chamber and the hold-down device chamber via a plurality of hoses, each of which have a length of 0.15-6 m.

5. The setting device according to claim 4, in which the pump hose and the tank hose between the tank and the pump and the valve block have a length of 5-30 m.

6. The setting device according to claim 4, in which the valve block comprises a plurality of valves, via which the return-stroke chamber is connectable with the pump and the hold-down device chamber so that a volume flow of the hydraulic fluid out of the hold-down device chamber supports a reset movement of the piston.

7. The setting device according to claim 1, in which the hold-down device is mechanically coupled with the plunger such that the plunger carries along the hold-down device with a movement opposite to a setting direction and/or the hold-down device carries along the plunger with a movement in the setting direction.

8. The setting device according to claim 1, the piston of which has a surface ratio between the piston surface without and with the piston rod of $1.1 \leq \Phi \leq 1.8$.

9. The setting device according to claim 1, the piston of which has a surface ratio between the piston surface with the piston rod and the piston surface of the plunge piston of $1.5 \leq \Phi \leq 5$.

10. The setting device according to claim 1, in which the valve block includes at least two pressure sensors, for determining pressure in the prestroke chamber and the hold-down device chamber, respectively.

11. The setting device according to claim 1, in which the valve block is designed as a stress relief component for the setting device with respect to the connected pump hose and the connected tank hose.

12. The setting device according to claim 1, in which the valve block is integrated into a cylinder arrangement consisting of the double-acting cylinder and the single-acting cylinder, so that no hoses are required between the valve block and the prestroke chamber, the return-stroke chamber and the hold-down device chamber.

13. A joining method for connecting at least two components, with the help of a hydraulically operated setting device with a hydraulic aggregate, which has the following features: the hydraulic aggregate with a tank for hydraulic fluid, a pump for pumping the hydraulic fluid to the setting device, at least one pump hose, which connects the tank with the setting device via the pump and a valve block, and at least one tank hose, which connects the tank with the setting device via the valve block, a double-acting cylinder with a prestroke chamber and a return-stroke chamber, in which the piston with the piston rod is moveably arranged in order to drive the plunger, a single-acting cylinder with a hold-down device chamber, in which a plunge piston is moveably arranged in order to drive the hold-down device, wherein the valve block comprises a plurality of valves, via which the return-stroke chamber can be connected with the pump and the hold-down device chamber, said setting method comprising the steps of:

a) introducing a first hydraulic volume flow of the hydraulic fluid into the prestroke chamber and the hold-down device chamber so that the piston with the plunger and the plunge piston with hold-down device are moved out of an initial position in the setting direction, b) connecting the return-stroke chamber with the prestroke chamber and the hold-down device chamber such that a first hydraulic return flow of the hydraulic fluid is diverted out of the return-stroke chamber into the at least one of prestroke chamber and the hold-down device chamber, c) increasing the hydraulic pressure in the prestroke chamber after the hold-down device and the plunger engage at a component to be connected, and the establishment of a connection by one of setting the fastening element in the component and deforming the component, d) introducing a second hydraulic volume flow of the hydraulic fluid into the return-stroke chamber so that the piston is moved in the direction of the initial position, and e) connecting the hold-down device chamber with the return-stroke chamber such that a second hydraulic return flow of the hydraulic fluid is diverted out of the hold-down device chamber into the return-stroke chamber and supports the movement of the piston into the initial position.

14. The joining method according to claim 13, comprising the additional step of:

carrying along of the plunge piston with hold-down device by the piston with piston rod and plunger when the piston moves back into its initial position.

15. The joining method according to claim 14, wherein the step of connecting the hold-down device chamber with the return-stroke chamber is started as soon as the carrying along of the plunge piston with the hold-down device takes place and the plunge piston displaces hydraulic fluid out of the hold-down device chamber.

16. The joining method according to claim 13, comprising the additional steps of:

prior to said first hydraulic volume flow introducing step, creating an overpressure hydraulic volume in the pump hose under increased pressure compared to a hydraulic pressure in the pump hose during the movement of the plunger and hold-down device in said first hydraulic volume flow introducing step; and releasing the overpressure hydraulic volume at the start of said first hydraulic volume flow introducing step such that the movement of the piston with the plunger and of the plunge piston with the hold-down device is accelerated.

17. The joining method according to claim 13, in which the hydraulic volume in the pump hose after the completed setting procedure under increased pressure in the pump hose is sealed between valves in order to create the overpressure hydraulic volume.

18. The joining method according to claim 13, comprising the additional step of:

heating the hydraulic fluid and the components of the circulation of the hydraulic fluid to an operating temperature, in which the hydraulic fluid is pumped into the tank via the pump hose, a pressure relief valve in the valve block and the tank hose and is heated by a pressure increase prior to the pressure release valve and a pressure release after the pressure relief valve.

19. A joint connection between at least two components, which has been established with the joining method according to claim 13, said joint connection being one of a punch rivet and clinch connection.

20. The joint connection between at least two components, which has been established with the hydraulically operated setting device according to claim 1, said joint connection being one of a punch rivet and clinch connection.

21. The setting device according to claim 4, in which the hold-down device is mechanically coupled with the plunger such that the plunger carries along the hold-down device with a movement opposite to a setting direction and/or the hold-down device carries along the plunger with a movement in the setting direction.

22. The setting device according to claim 4, the piston of which has a surface ratio between the piston surface without and with the piston rod of $1.1 \leq \Phi \leq 1.8$.

23. The setting device according to claim 4, the piston of which has a surface ratio between the piston surface with the piston rod and the piston surface of the plunge piston of $1.5 \leq \Phi \leq 5$.

24. The setting device according to claim 4, in which the valve block includes at least two pressure sensors, for determining pressure in the prestroke chamber and the hold-down device chamber, respectively.

25. The setting device according to claim 4, in which the valve block is designed as a stress relief component for the setting device with respect to the connected pump hose and the connected tank hose.

26. The setting device according to claim 4, in which the valve block is integrated into a cylinder arrangement consisting of the double-acting cylinder and the single-acting cylinder, so that no hoses are required between the valve block and the prestroke chamber, the return-stroke chamber and the hold-down device chamber.

27. The joint connection between at least two components, which has been established with the hydraulically operated setting device according to claim 4, said joint connection being one of a punch rivet and clinch connection.

* * * * *